US005099640A

United States Patent [19]

Kobayashi et al.

[11] Patent Number: 5,099,640

[45] Date of Patent: Mar. 31, 1992

[54] APPARATUS AND METHOD FOR CONTROL OF A SPINNING MACHINE

[75] Inventors: Hideaki Kobayashi, Sakura; Takeshi Obata, Narashino, both of Japan

[73] Assignee: Hitachi, Ltd., Tokyo, Japan

[21] Appl. No.: 512,503

[22] Filed: Apr. 20, 1990

Related U.S. Application Data

[63] Continuation of Ser. No. 254,307, Oct. 6, 1988, abandoned.

[30] Foreign Application Priority Data

Oct. 9, 1987 [JP] Japan ..... 62-253602

[51] Int. Cl.[5] ..... D01H 13/00

[52] U.S. Cl. ..... 57/264; 57/97; 57/100

[58] Field of Search ..... 57/264, 93, 94, 96, 57/97, 100, 75

[56] References Cited

U.S. PATENT DOCUMENTS

| | | | |
|---|---|---|---|
| 3,943,689 | 3/1976 | Kunz et al. | 57/264 |
| 4,336,684 | 6/1982 | Hartmannsgruber et al. | 57/94 X |
| 4,455,817 | 6/1984 | Mehta | 57/100 X |
| 4,519,202 | 5/1985 | Hausner | 57/264 |

*Primary Examiner*—Joseph J. Hail, III

*Attorney, Agent, or Firm*—Antonelli, Terry, Stout & Kraus

[57] ABSTRACT

A spinning machine and method of control thereof wherein the spinning machine includes spindles for winding twistings or single yarns and including peripheral equipment for the spindles wherein the spindles and peripheral equipment are individually driven. A speed detector detects the rotation speed of at least one of the spindles and the peripheral machinery and a speed control arrangement is provided for controlling the speed of one of the spindles and the peripheral equipment in response to the detected speed so as to enable operation of the spindles and the peripheral machinery in a corresponding or synchronized manner. By the synchronized operation of the spindles and the peripheral machinery, yarns of excellent quality can be obtained.

15 Claims, 6 Drawing Sheets

APPARATUS AND METHOD FOR CONTROL OF A SPINNING MACHINE

BACKGROUND OF THE INVENTION

This invention relates to a spinning machine comprising spindles for winding twistings or single yarns and peripheral equipment group of the spindles which are individually driven by an electric motor, and, more particularly to a method of control suitable for use in synchronous drive of electric motors which are individually operated.

Conventionally, a method in which spindles for winding twistings or single yarns and periphery equipment group such as draft rolls or ring rails which work in association with these spindles are driven by a single electric motor via a reducer or a proper driving belt has been in practice. In this equipment configuration, the drive of spindles and that of periphery equipment group of the spindles are conducted in a synchronized manner.

Recently, in order to improve the working efficiency of spindle machines, high speed operation of spindles are planned. In this case, in order to provide high-speed operation of spindles, a method is employed in which each spindle is driven by an individual unit electric motor and high frequency AC power is supplied to these unit motors by a frequency variable power source device. In order to synchronously drive spindles and periphery equipment group of the spindles, a method is taken into consideration in which the above two types of components are driven by the same variable frequency power source device, or a method is taken into consideration in which driving power sources for the above two types of components are individually provided and the ratio of outputs (frequencies) of the two power source devices are controlled to be constant.

Devices relative to such types are exemplified by those disclosed in Japanese Patent Publication No. 32864/1979, Japanese Patent Laid-Open No. 204929/1984 and Japanese Patent Laid-Open No. 155729/1985.

PROBLEMS TO BE SOLVED BY THE INVENTION

In the above-described prior art, the synchronized drive of spindles and periphery equipment group of the spindles are not sufficiently considered. Therefore, when a change in supplied voltage or a change in temperature on the inside of a driving electric motor occurs during the continuous operation of the spindles, the rotational speeds of the spindles vary. Therefore, a synchronized operation state with respect to the periphery equipment cannot be maintained. Consequently the quality of the products is deteriorated.

Particularly, in a case where the spindles and its periphery equipment group are driven by a single variable frequency power source device, since the operating speed of the periphery equipment group is relatively low with respect to that of the spindle, a driving system with a large gear reduction ratio needs to be provided. Furthermore, since there is the difference in inertial mass between the spindles and the periphery equipment, it is difficult to conduct synchronized operation at the time of starting and stopping the spindle machine. Consequently, the quality of the products is deteriorated or breakage of thread occurs.

A method in which a speed detector is provided in the spindle for the purpose of controlling threads in a closed-loop manner may be used. However, if the rotational speed of the spindles reaches several ten thousand (rpm), the critical speed of the spindle itself is lowered only by mounting the speed detector. Therefore, it presents a problem in mounting the speed detector.

SUMMARY OF THE INVENTION

An object of the present invention is to provide a spinning machine in which the synchronous operation of a spindle and periphery equipment can be assuredly conducted.

The above-described objects can be achieved by A spinning machine comprising a spindle means for attaching a bobbin to wind a yarn thereon, a first motor means for rotating said spindle means, a first power source means for supply electric power to said first motor means, a first speed control means for controlling speed of said first motor means, a peripheral machinery means for supplying said yarn to said spindle means, a second motor means for driving said peripheral machinery means, a second power source means for supplying electric power to said second motor means, a speed detecting means for detecting speed of said spindle means, a second speed control means for controlling speed of said second motor means in response to said detecting means to drive said peripheral machinery means in accordance with said spindle means. By providing synchronous operation control means which conducts the control of the operation of an electric motor for driving the periphery equipment of the spindle in accordance with a speed signal detected by a speed detector, the periphery equipment group of the spindle can be operated in a synchronized manner with the spindle. According to the present invention, the assuredly synchronous operation of the spindle and its periphery equipment group can be conducted. Consequently, according to the spinning machine according to the present invention, yarns of excellent quality can be obtained.

DESCRIPTION OF THE PREFERRED EMBODIMENT

Embodiments of the present invention will be described with reference to FIG. 1 to FIG. 6.

Figure 1:
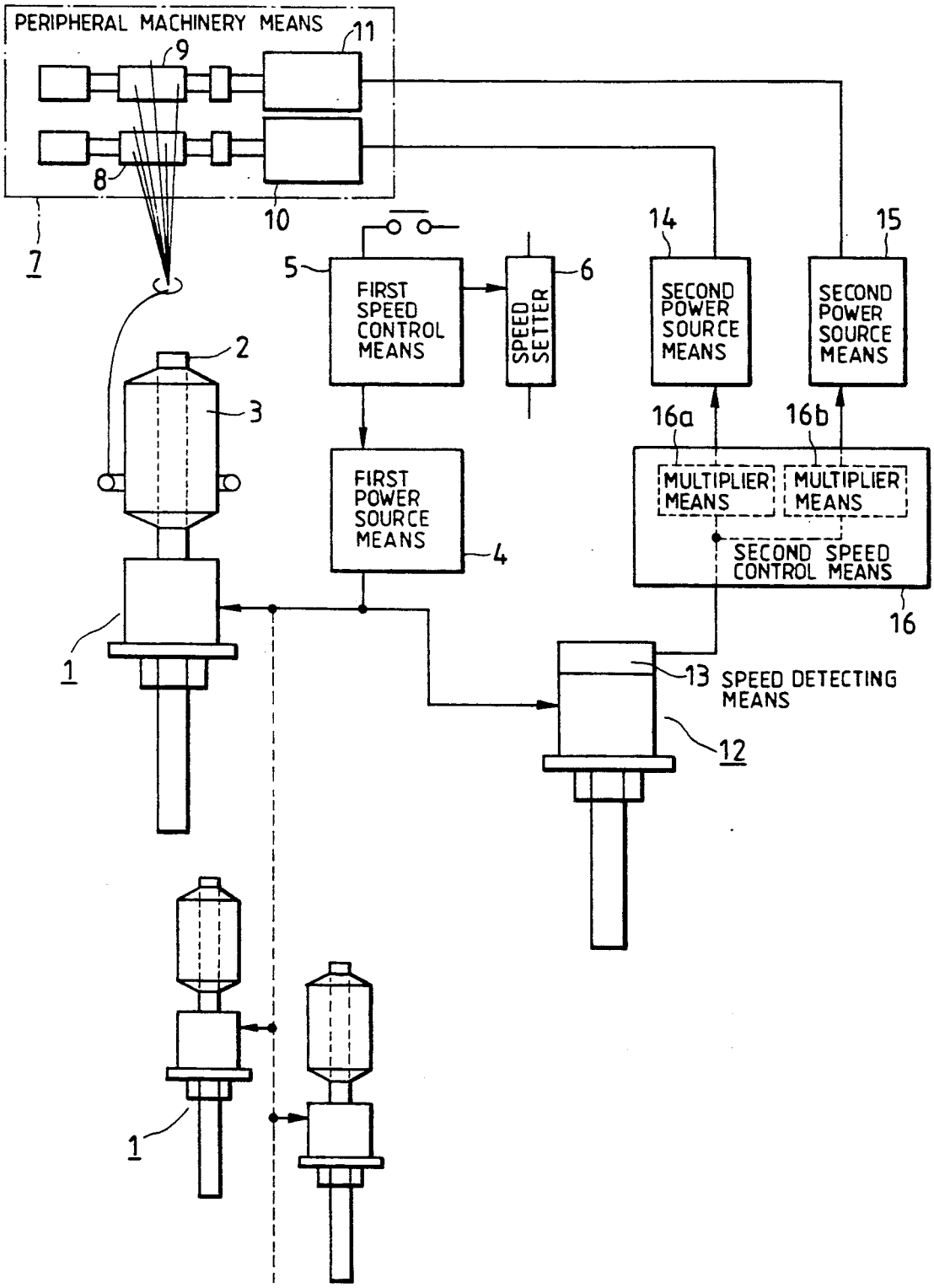
FIG. 1 is a block diagram illustrating the first embodiment of the present invention.
Figure 2:
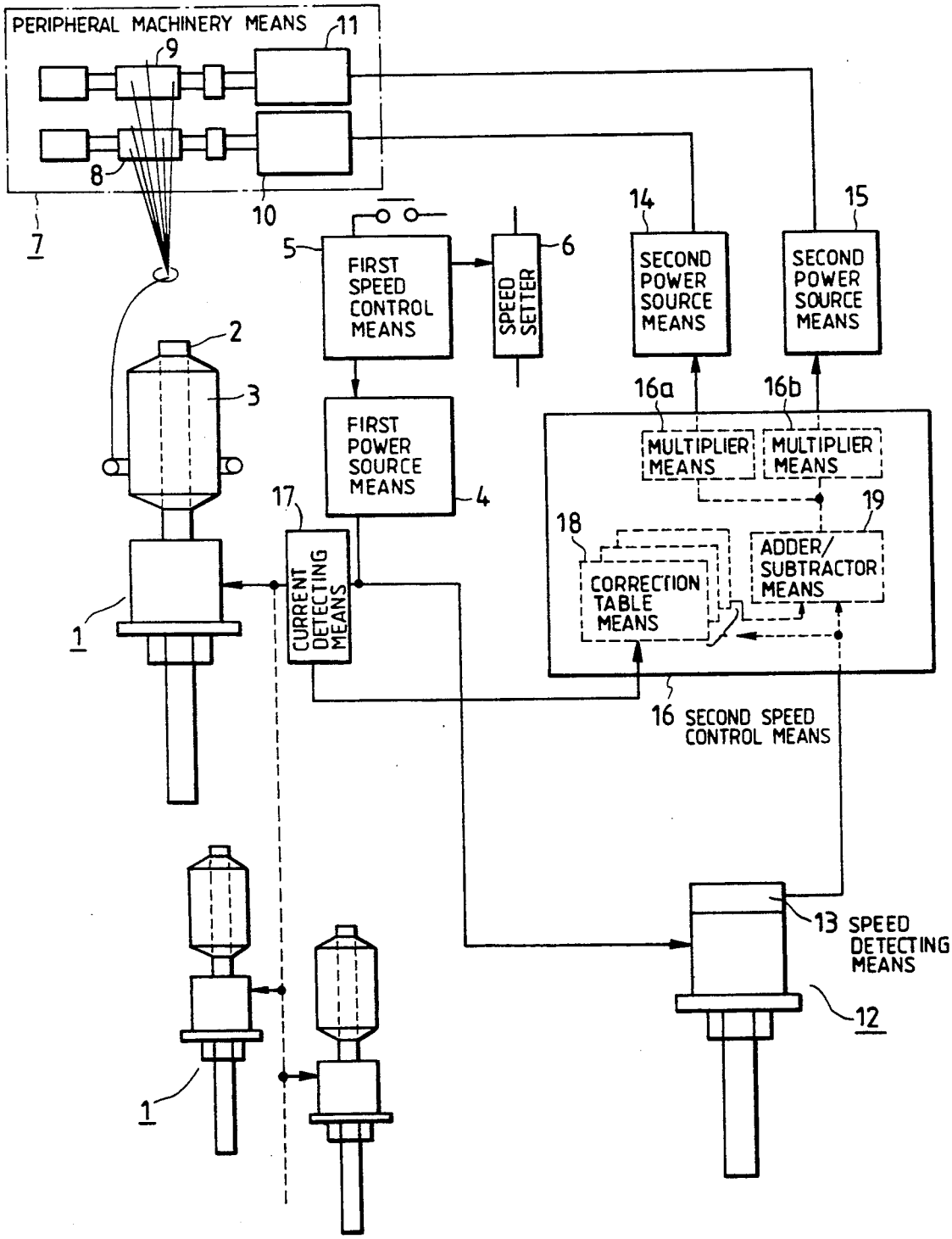
FIG. 2 is a block diagram illustrating the second embodiment.

The first embodiment will be described with reference to FIG. 1.

That is, reference numeral 1 represents spindles to which a bobbin 2 for winding twistings or single yarns (to be called simply "yarn 3" hereinafter) is mounted respectively. A non-synchronous electric motor such as three phase induction motor as a first motor means (to be called simply "induction motor" hereinafter) is mounted in each of this spindle 1. Each spindle 1 is individually driven. Although the internal structure of this spindle 1 will not be detailed, a known insert bearing device and the like are built in. Several tens of this type of spindles 1 are in parallel disposed on one spinning machine. Reference numeral 4 represents variable frequency voltage power source device (to be called simply "inverter" hereinafter) as a first power source means. It, on receipt of a speed command, supplies three phase AC power with a needed frequency corresponding to the speed command to the induction motor of each of the spindles 1 from a commercial power source not illustrated. As the inverter 4 of the type described above, those of a PAM (Pulse Amplitude Modulation) type or PWM (Pulse Width Modulation) type are known. Reference numeral 5 represents an operation control device as a first speed control means which issues a speed command to the inverter 4 and controls the speed command in order to have the operation conducted at an aimed operation speed which has been set in a speed setter 6 or in order to have acceleration and deceleration of the spindle 1 conducted smoothly at the time of start of stop or the spindle 1. Specifically, it raises the speed command in accordance with the start command, which is not detailed, up to a value corresponding to an aimed operating speed which has been set by the speed setter 6 at a predetermined rate of rise. Furthermore, in accordance with a stop command, control needed for the speed command to be decreased at a predetermined rate of reduction and for the spindle 1 to be stopped is conducted.

If necessary, the operation control device 5 can sequence-control the value of the speed command for the purpose of making tension applied to the thread 3 constant and assuring the needed quality for the thread during the winding process for the spindle 9. Reference numeral 7 represents peripheral equipment group as a peripheral machinery means to be operated in synchronization with the spindles 1. This peripheral equipment group 7 aids to draw out, wind and spin the threads. A ring rail, a draft part or the like may be an example of the equipment group. As a representative, two draft rolls 8 and 9 are shown. Reference numerals 10 and 11 represent non-synchronous electric motors each as a second motor means, for example, induction electric motors, which are directly, or via a proper reduction mechanism, connected for the purpose of respectively driving the two draft rolls 8 and 9. Reference numeral 12 represents a monitoring machine which is driven by an induction motor similar to that for the spindles 1, and which has a similar mechanical structure to that for the spindle 1. That is, the only difference between this monitoring machine 12 and the spindle 1 lies in that a speed detector 13 as a speed detecting means for detecting revolutions is connected, instead of a bobbin 2 for winding the threads at its upper portion.

It has been difficult to mount in the above-described type of the speed detector 13 in the spindle 1 in which unbalance in the rotational system thereof increases as the winding of threads proceeds, because a critical speed of the spindle can be lowered. However, it can be easily mounted on the monitoring machine 12 which can be structured in such a manner that the balance of the rotational system can be always assured. Reference numerals 14 and 15 variable frequency voltage power source device each as a second power source means (to be simply called "inverter" hereinafter) each of which supplies an AC power to the induction motors 10 and 11. It has the same structure as that of the above-described inverter 4. However, since the periphery equipment group 7 does not need to be operated at high speed unlike the spindle 1, the range of variation of the output frequency of these inverters 14 and 15 is, mostly, determined in such a manner that the range is narrower than that for the above-described inverter 4. Reference numeral 16 represents a synchronous operation control means to which a speed signal which has been detected by the speed detector 13 of the monitoring machine 12 is input. It then issues, in accordance with this speed signal, a necessary speed command to the inverters 14 and 15 for the purpose of making a rotation ratio of the operating speed of the induction motors 10 and 11 to the operating speed of the monitoring machine 12 a predetermined value.

The operation of the spinning machine structured as described above will now be described. When the monitoring machine 12 is connected to the inverter 4 which is also connected to the spindle 1, and a start switch, omitted from the illustrating, is switched on, the operation control device 5 issues a speed command to the inverter 4 in order to have the operating speed (rotational speed) of the spindle 1 raised up to an aimed operating speed which has been set in the speed setter 6. In response to this speed command, the inverter 4 generates an AC power with a frequency and voltage corresponding to this speed command, and it is supplied to the spindles 1 and the monitoring machine 12. Therefore, the spindles 1 and the monitoring machine 12 start operating in the same conditions. The spindles 1 starts winding yarns 3, while the monitoring machine 12 outputs a speed signal through the speed detecting device 13. In this state, since the monitoring machine 12 is operated in the same condition as that for the spindle 1, the speed signal which can be obtained through the speed detecting device 13 of the monitoring machine 12 can be assumed to equivalently represents the operating condition of the spindle 1. The synchronous operation control means 16 comprises multiplier mean **16*a*, 16*b* which multiply a necessary coefficient in accordance with the speed signal obtained from the speed detecting device 13 for the purpose of making the rotational ratio between the induction electric motors 10 and 11 and the spindle 1 a predetermined constant value. Next, it issues the speed command to the inverters 14 and 15. As a result, the induction electric motors 10 and 11 (peripheral equipment group 7) are operated in a synchronized manner with the spindle 1** with a predetermined rotational ratio maintained.

Furthermore, the rotational speed ratio and the synchronous operation relation between the spindle 1 and the induction electric motors 10 and 11 are assuredly maintained at the time of deceleration or stoppage of the spindle 1 similarly to the time of starting the spindle 1.

It can be assumed that the output frequency or the output voltage of the inverter 4 varies due to other factors (for example, change in the commercial power source voltage for the inverter 4), affecting the rotational speed of the spindle 1. However, even in such case, the change in the rotational speed of the spindle 1 can be assuredly detected by means of the monitoring machine 12 which is driven by the same power source. This change data can be supplied to the synchronous operation control means 16 so that the synchronous operation relationship can be maintained. Furthermore, it can be assumed that the spindle 1 is affected slightly by change in the internal temperature, the state of the lubricating oils, and the fatigue of the insert bearing device. However, in this case, by disposing the monitoring machine 12 in the environment similar to that for the spindle 1, the change in the rotational speed of the spindle 1 can be assuredly detected and each synchronous operation can be obtained similarly to the above-described example.

According to the above-described embodiment, by controlling, in accordance with the speed signal of the monitoring machine 12 of the spindle, the periphery equipment group 7 which rotates slower than the spindle 1 and the inertia mass thereof is smaller than the same, the periphery equipment group 7 can immediately be operated in a following-up manner so that the needed portion of the spinning machine can be operated in a synchronized manner.

Although, in the embodiment, two draft rolls 8 and 9 for the periphery equipment group 7 are employed and are respectively driven by the induction motors 10 and 11, the power generated by only one induction electric motor can be distributed to another means, for example, a third draft roll through a proper reduction mechanism or transmission mechanism.

In the embodiment described with reference to FIG. 1, the amount of the difference in the slip between the induction motor for driving the spindle 1 and the induction motor for driving the monitoring machine 12 has been ignored in the description. However, strictly speaking, there is a slight difference between the two motors. That is, in the spindle 1, as the winding of the yarn 3 proceeds, the amount of load applied to the induction motor for driving the spindle 1 is increased, causing the amount of slip to increase. As a result, some difference is created between the spindle and the monitoring machine 12 in which the load thereof is not changed. The change in the amount of slip of the induction motor which drives the spindle 1 can be estimated as the change in power consumed by this induction motor or the change in the input current which is supplied. Next, the second embodiment in which the above-described matter is improved will be described with reference to FIG. 2. That is, reference numeral 17 represents an input detecting device which measures the input current or the power consumption of the spindle 1. Reference numerals 18 and 19 respectively represent a correction table as a correction table means disposed in the synchronous operation control means 16 and an adder/subtractor means disposed in the same. That is, the correction table 18 stores the relationship between the input current or the power consumption (input) of the spindle 1 and the amount of slip which has been previously measured or estimated. The adder/subtractor 19 adds the amount of slip detected by way of referring to the correction table 18 to the speed signal which has been detected by the monitoring machine 12 and then corrects it. More specifically, since the increase in the input current or power consumption means the increase in the amount of slip of the electric motor for the spindle 1, the value subtracting the amount of speed signal equivalent to the amount of slip from the speed signal detected by the monitoring machine 12 becomes the amount equivalent to the actual rotational speed of the spindle 1. By controlling of the operation of the induction motors 10 and 11 with the inverters 14 and 15 similarly to the above-described embodiment with the speed signal in which the amount of slip has been corrected, the periphery equipment group 7 is brought into a synchronous operation state following the spindle 1.

Furthermore, since the relationship between the amount of slip of the spindle 1 and its power consumption or the input current is affected by the change in the frequency of the power supplied to the spindle 1 from the inverter 4, a plurality of types of the correction tables 18 can be provided for each operation speed range of the spindle 1 so as to be switched in accordance with the speed signals of the monitoring machine 12 for referring. As described above, by conducting the correction control of the amount of slip, the synchronous operation of the peripheral equipment group 7 can be further assuredly conducted at any time including starting of the spindle 1 and the stoppage of the same.

Furthermore, in order to correct the effect of the amount of slip of the monitoring machine 12, an input detection device and a correction table for the amount of slippage, as with the spindle 1, may be provided for the purpose of correcting the speed signal of the monitoring machine 12.

Furthermore, since the induction motors 10 and 11 involves slip, the operating speed of the induction motors 10 and 11 and the synchronous speed with the output frequency of the inverters 14 and 15 do not, strictly speaking, coincide.

Therefore, in order to remove this effect, a tachometer generator is connected to the induction motors 10 and 11 to form a known closed loop control including the inverters 14 and 15. It is relatively easy to connect these tachometer generators since the rotational speed of the induction motors 10 and 11 are sufficiently low with respect to that of the spindle 1 and a variety of the rotation mechanism portions connected to it are available.

The correction of the speed signal of the monitoring machine 12 due to increase in load of the spindle 1 is conducted with the amount of slip of the spindle 1. However, in a case where the winding pattern (load change) of the spindle 1 can be determined, the correction value of the speed signal needed in accordance with the thread winding process may be previously stored for the purpose of similarly conducting a similar synchronous operation control in accordance with the stored value.

Figure 3:
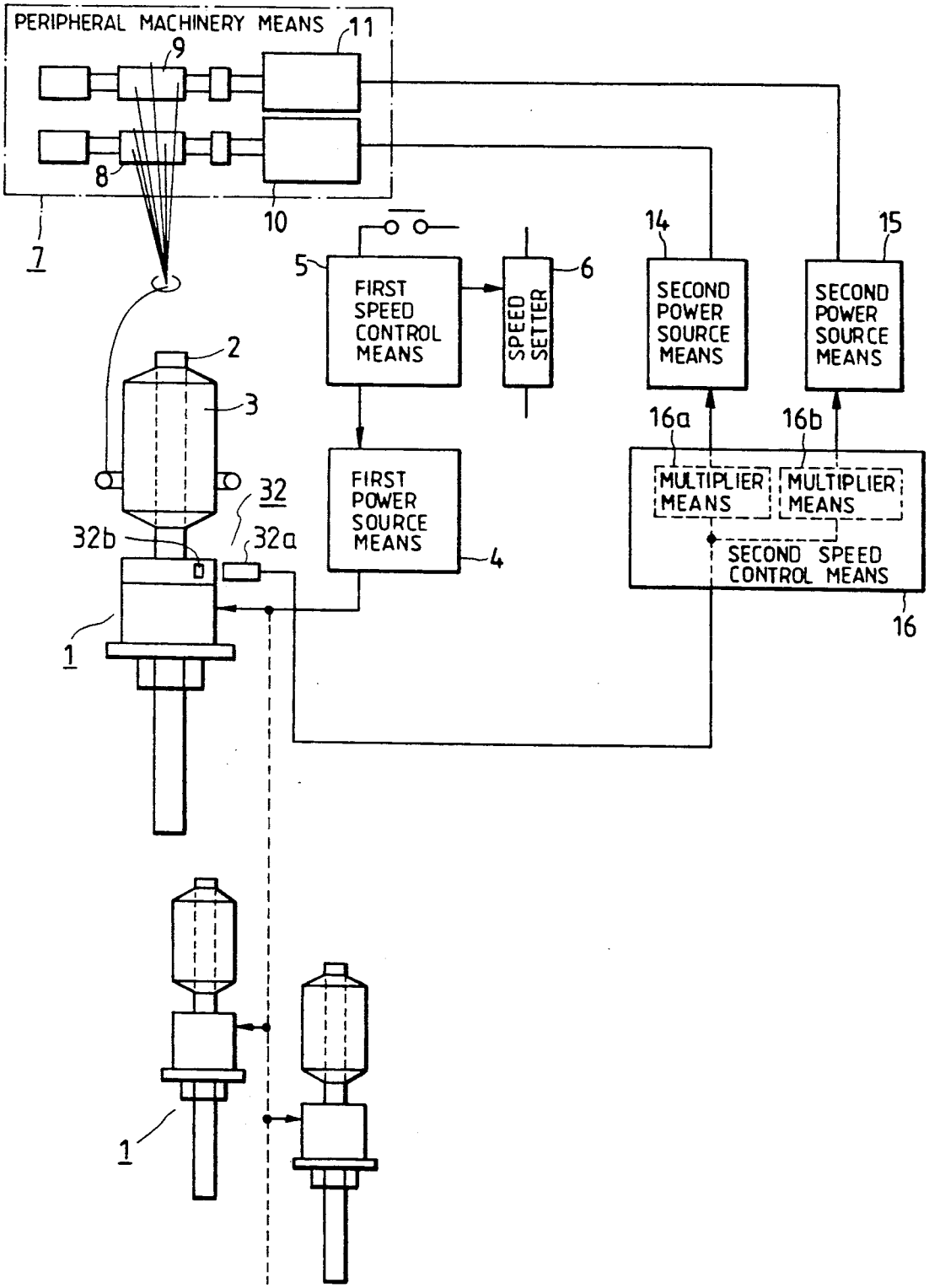
FIG. 3 is a block diagram illustrating the third embodiment.

The third embodiment will be described with reference to FIG. 3. In this embodiment, a magnetic sensor means 32 is used as a speed detecting means. The magnetic sensor means 32 comprises a magnetic sensor **32*a* and a magnetized part 32*b* disposed on the spindle 1. Sensor 32*a* is disposed close to the spindle 1 so as to detect the magnetic field generated by the magnetized part 32*b*. By this embodiment, rotation speed of the spindle 1** is detected directly and correctly.

Figure 4:
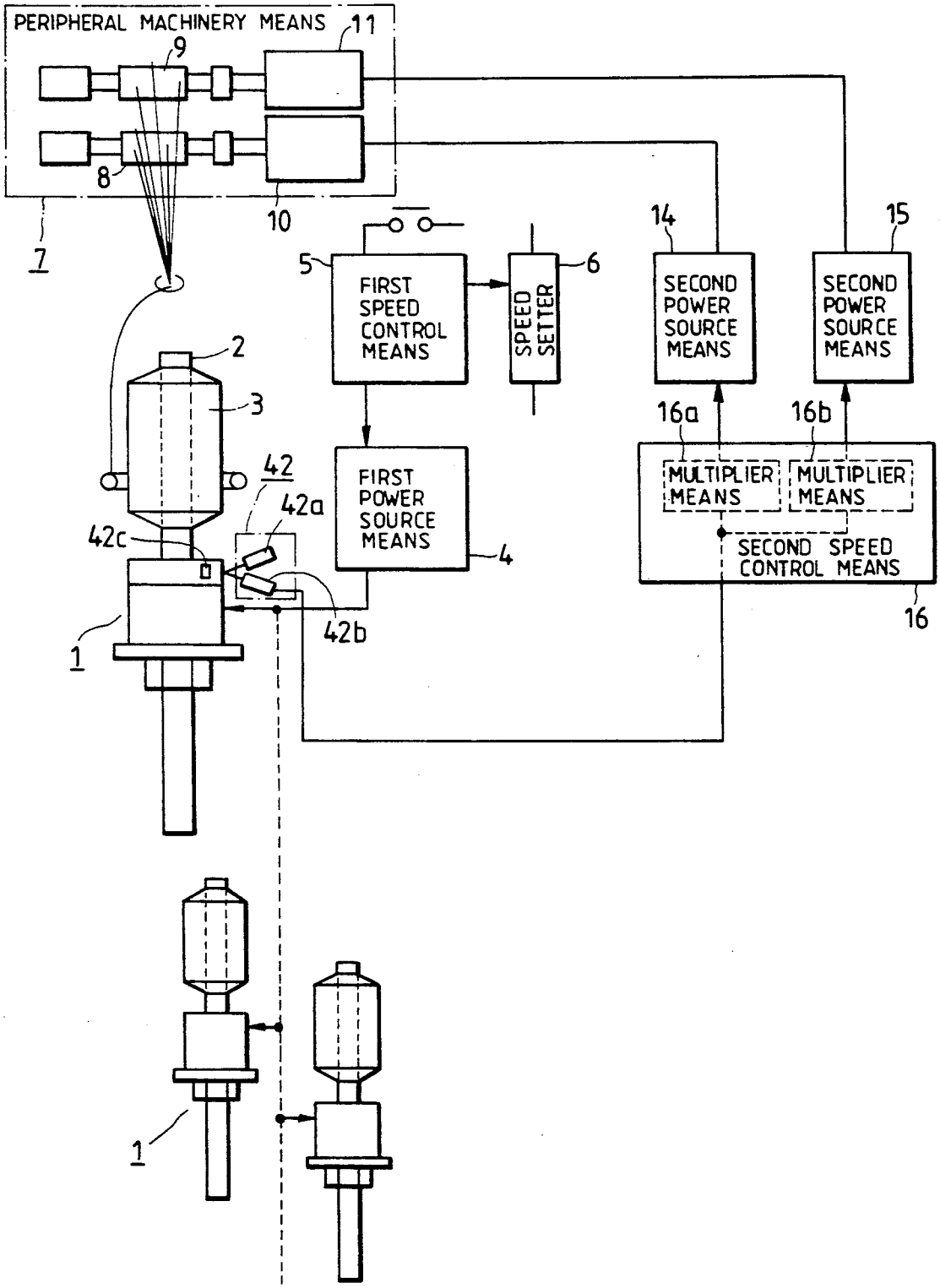
FIG. 4 is a block diagram illustrating the fourth embodiment.

The fourth embodiment will be described with reference to FIG. 4. In this embodiment, an optical sensor 42 is used as a speed detecting means. The optical sensor 42 comprises a light emitting part **42*a*, a light receiving part 42*b*, and a light reflecting part 42*c*. The light reflecting part 42*c* is disposed on the outer surface of spindle 1. The light emitting part 42*a* and the light receiving part 42*b* is disposed close to the spindle 1 and so as to detect the reflected beam. By this embodiment, rotation speed of the spindle 1** is detected directly and correctly. Further in this embodiment, since the sensor 42 detects optical pulse generated by reflection at the light reflecting part 42*c*, the effect of noise can be neglected.

Figure 5:
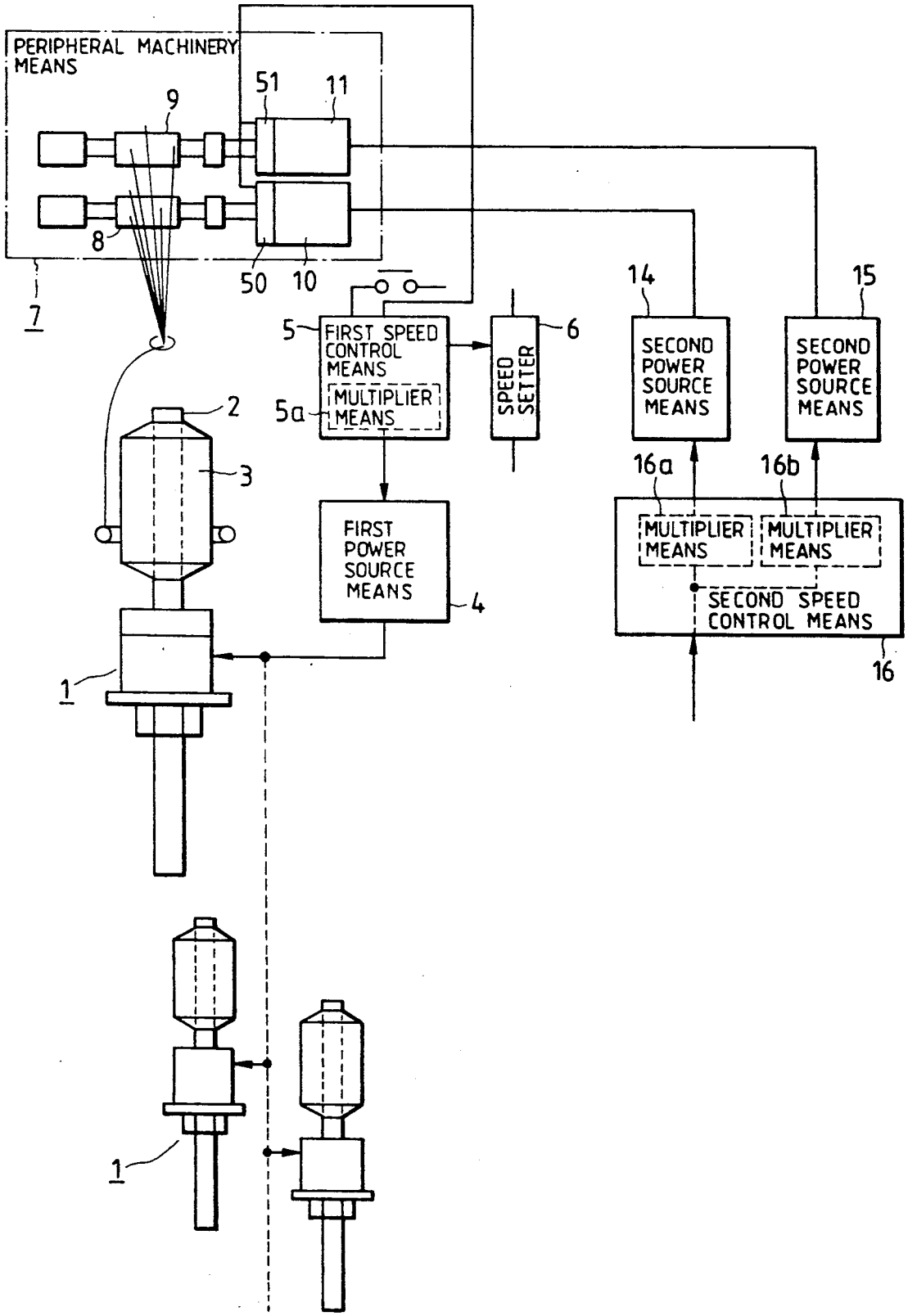
FIG. 5 is a block diagram illustrating the fifth embodiment.

The fifth embodiment will be described with reference to FIG. 5. In this embodiment, encoders 50, 51 respectively mounted on motor 10, 11 are used as speed detecting means of peripheral machinery means 7. The outputs of encoders 50, 51 are connected to a multiplier means 5*a* disposed in the first speed control means. In this embodiment, speeds of motors 10, 11 in the peripheral machinery means are detected and used to control the speed of spindle 1. The ratio of rotating speed between spindle 1 and motors 10, 12 is also kept predetermined constant value.

Figure 6:
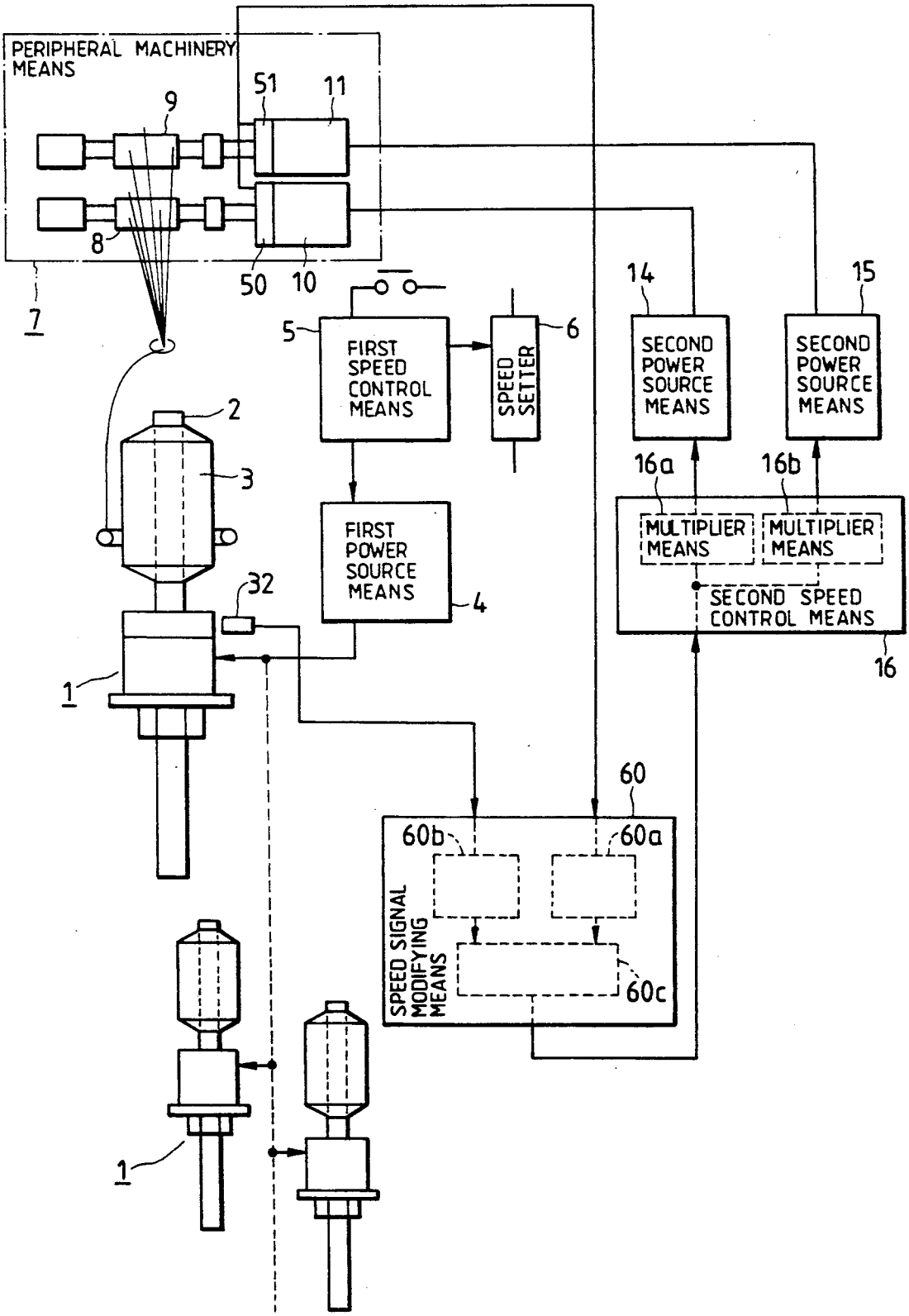
FIG. 6 is a block diagram illustrating the sixth embodiment.

The sixth embodiment will be described with reference to FIG. 6. In this embodiment speed detecting means are disposed for detecting the speed of spindle 1 and motors 10, 11. To detect the speed of spindle 1, magnetic sensor means 32 is used as speed detecting means, and as for motors 10, 11, encoders 50, 51 are used as second speed detecting means. Speed signal modifying means comprises multiplier means 60*a*, 60*b* and a modifier 60*c*.

Output of magnetic sensor 32 is connected to a multiplier means 60*b*, and output of encoders 50, 51 are connected to a multiplier means 60*a*. Outputs of multiplier means 60*a*, 60*b* are respectively connected to modifier 60*c*.

The flow of the speed signal detected is as follows. The output of magnetic sensor 32 is supplied to a multiplier means 60*a* where coefficient is multiplied, then transmitted to modifier 60*c*. The outputs of encoders 50, 51 are supplied to a multiplier means 60*a* where coefficient is multiplied then transmitted to modifier 60*c*. Modifier 60*c* modifies a signal from multiplier means 60*b* according to a signal from multiplier 60*b*. For instance, if the speed of motor 10 is slower than the predicted speed, the modifier 60*c* increases the output of multiplier means 60*a*, and if the speed of motor 10 is faster than the predicted speed, the modifier 60*c* decreases the output of multiplier means 60*a* to correct the speed of motor 10.

What is claimed is:

1. A control apparatus for a spinning machine comprising:
- spindle means for attaching a bobbin to wind a yarn thereon,
- first motor means for rotating said spindle means,
- first power source means for supplying electric power to said first motor means,
- first speed control means connected with said first power source means for controlling the speed of said first motor means,
- speed detecting means for indirectly detecting an actual rotation speed of said spindle means by directly detecting the actual rotation speed of a third motor means operating in a manner corresponding to the first motor means and without a bobbin for winding yarn thereon,
- peripheral machinery means for supplying said yarn to said spindle means,
- second motor means for driving said peripheral machinery means,
- second power source means for supplying electric power to said second motor means, and
- second speed control means connected with said second power source means for controlling the speed of said second motor means,
- said second speed control means being responsive to the speed detected by said speed detecting means for controlling said second motor means so as to effect rotation of said second motor means in accordance with the rotation speed of said spindle means.

2. A control apparatus for a spinning machine according to claim 1, wherein said third motor means is driven by said first power source means, said third motor means being disposed so as to rotate at the same speed as of said first motor means, and said speed detecting means being connected to said third motor means.

3. A control apparatus for a spinning machine according to claim 1, wherein said second speed control means controls said second motor means in response to said speed signal so as to operate said second motor means in a synchronized manner with said spindle means.

4. A control apparatus for a spinning machine comprising:
- spindle means for attaching a bobbin to wind a yarn thereon,
- first motor means for rotating said spindle means,
- first power source means for supplying electric power to said first motor means,
- first speed control means connected with said first power source means for controlling the speed of said first motor means,
- speed detecting means for detecting an output indicative of a rotation speed of said spindle means,
- peripheral machinery means for supplying said yarn to said spindle means,
- second motor means for driving said peripheral machinery means,
- second power source means for supplying electric power to said second motor means, and
- second speed control means connected with said second power source means for controlling the speed of said second motor means, said second speed control means being responsive to the speed output detected by said speed detecting means for controlling said second motor means so as to effect rotation of said second motor means in accordance with the rotation speed of said spindle means,
- wherein said second speed control means further comprises a multiplier means for multiplying a coefficient to make a rotational ratio between said second motor means and said spindle means a predetermined constant value.

5. A method of controlling a spinning machine having a speed detecting means of a spindle means and a speed control means of peripheral machinery means comprising the steps of:
- indirectly detecting an actual rotation speed of said spindle means by directly detecting the actual rotation speed of a motor means without a bobbin for winding yarn thereon and operating in a manner corresponding to another motor means driving said spindle means and outputting a speed signal in response to said detected rotation speed to said speed control means, and
- controlling a rotation speed of said peripheral machinery means in response to said speed signal so as to effect rotation of said peripheral machinery in accordance with the rotation speed of said spindle means.

6. A method of controlling a spinning machine having a speed detecting means of a spindle means and a speed control means a peripheral machinery means comprising the steps of:

indirectly detecting an actual rotation speed of said spindle means by directly detecting the actual rotation speed of a motor means without a bobbin for winding yarn thereon and operating in a manner corresponding to another motor means driving said spindle means and outputting a speed signal in response to said detected rotation speed to said speed control means, varying the frequency of a power source means in response to said speed signal, and supplying power from said power source means with the varied frequency to said peripheral machinery means so as to effect rotation of said peripheral machinery means in accordance with the rotation speed of said spindle means.

7. A method of controlling a spinning machine according to claim 6, wherein said peripheral machinery means is controlled in a synchronized manner with said spindle means.

8. A method of controlling a spinning machine having a speed detecting means of a spindle means and a speed control means of peripheral machinery means comprising the steps of:

detecting an output indicative of the rotation speed of said spindle means and outputting a speed signal in response to said rotation speed to said speed control means;

varying the frequency of a power source means in response to said speed signal; and supplying power from said power source means with the varied frequency to said peripheral machinery means so as to effect rotation of said peripheral machinery means in accordance with the rotation speed of said spindle means;

wherein said frequency of power source is varied so as to drive said peripheral machinery at a speed with constant ratio to that of said spindle means.

9. A control apparatus comprising:

spindle means for attaching a bobbin to wind a yarn thereon, first motor means for rotating said spindle means, first power source means for supplying electric power to said first motor means, first speed control means connected with said first power source means for controlling the speed of said first motor means, speed detecting means for detecting an output indicative of a rotation speed of said spindle means, peripheral machinery means for supplying said yarn to said spindle means, second motor means for driving said peripheral machinery means, second power source means for supplying electric power to said second motor means, and second speed control means connected with said second power source means for controlling the speed of said second motor means, said second speed control means being responsive to the speed output detected by said speed detecting means for controlling said second motor means so as to effect rotation of said second motor means in accordance with the rotation speed of said spindle means, and further comprising a second speed detecting means attached on said second motor means, speed signal modifying means connected to said speed detecting means and said second speed detecting means for modifying a speed signal from said speed detecting means according to a speed signal from said second speed detecting means, wherein said speed signal modifying means outputs said modified speed signal to said second speed control means.

10. A method of controlling a spinning machine having spindle means, peripheral machinery means, speed detecting means and speed control means, the method comprising the steps of:

indirectly detecting an actual rotation speed of the spindle means and the peripheral machinery means by directly detecting the actual rotation speed of a motor means without a bobbin for winding yarn thereon and operating in a manner corresponding to another motor means driving said spindle means, and providing an output signal indicative thereof; and controlling the speed of the peripheral machinery means in response to the speed signal so as to effect rotation of the peripheral machinery means in accordance with the rotation speed of the spindle means.

11. A control apparatus for a spinning machine comprising:

spindle means for attaching a bobbin to wind a yarn thereon, first motor means for rotating said spindle means, first power source means for supplying electric power to said first motor means, first speed control means connected to said first power source means for controlling said first power source means so as to control the speed of said first motor means, speed detecting means for indirectly detecting an actual rotation speed of said spindle means by indirectly detecting the actual rotation speed of a third motor means operating in a manner corresponding to the first motor means and without a bobbin for winding yarn thereon, and outputting a speed signal indicative thereof, peripheral machinery means for supplying said yarn to said spindle means, second motor means for driving said peripheral machinery means, second power source means for supplying electric power to said second motor means, and second speed control means connected to said speed detecting means and to said second power source means for controlling said second power source means so as to control the speed of said second motor means, said second speed control means being responsive to said speed signal and including multiplier means for multiplying said speed signal by a coefficient to provide an output signal for controlling said second motor means so as to effect rotation of said second motor means in accordance with the rotation speed of said spindle means.

12. A control apparatus for a spinning machine according to claim 11, wherein said second speed control means controls said second power source means so as to vary a frequency thereof in response to said speed signal, and said second power source means supplies power with the varied frequency to said peripheral machinery means.

13. A control apparatus for a spinning machine. A control apparatus for a spinning machine comprising:

spindle means for attaching a bobbin to wind a yarn thereon, first motor means for rotating said spindle means, first power source means for supplying electric power to said first motor means, first speed control means connected to said first power source means for controlling said first power source means so as to control the speed of said first motor means, speed detecting means for detecting an output indicative of a rotation speed of said spindle means and outputting a speed signal in response to said output, peripheral machinery means for supplying said yarn to said spindle means, second motor means for driving said peripheral machinery means, second power source means for supplying electric power to said second motor means, and second speed control means connected to said speed detecting means and to said second power source means for controlling said second power source means so as to control the speed of said second motor means, said second speed control means being responsive to said speed signal and including multiplier means for multiplying said speed signal by a coefficient to provide an output signal for controlling said second motor means so as to effect rotation of said second motor means in accordance with the rotation speed of said spindle means, wherein said second speed control means controls said second power source means so as to vary a frequency thereof in response to said speed signal, and said second power source means supplies power with the varied frequency to said peripheral machinery means, and wherein said frequency is varied so as to drive said peripheral machinery means at a rotation speed with a constant ratio to that of said spindle means.

14. A control apparatus for spinning machine comprising:

spindle means for attaching a bobbin to wind a yarn thereon, first motor means for rotating said spindle means, first power source means for supplying electric power to said first motor means, first speed control means connected with said first power source means for controlling the speed of said first motor means, speed detecting means for indirectly detecting an actual rotation speed of said spindle means by directly detecting the actual rotation speed of a third motor means without a bobbin for winding yarn thereon and operating in a manner corresponding to said first motor means, and outputting a speed signal in response to the rotation speed, peripheral machinery means for supplying said yarn to said spindle means, second motor means for driving said peripheral machinery means, second power source means for supplying electric power to said second motor means, second speed control means connected with said speed detecting means and with said second power source means for controlling a rotation speed of said second motor means, said second speed control means varying the frequency of said second power source means in response to said speed signal, and said second power source means supplying power therefrom with the varied frequency to said peripheral machinery means so as to effect rotation of said peripheral machinery means in accordance with the rotation speed of said spindle means.

15. A control apparatus for spinning machine comprising:

spindle means for attaching a bobbin to wind a yarn thereon, first motor means for rotating said spindle means, first power source means for supplying electric power to said first motor means, first speed control means connected with said first power source means for controlling the speed of said first motor means, speed detecting means for indirectly detecting an actual rotation speed of said spindle means and outputting a speed signal in response to the rotation speed, peripheral machinery means for supplying said yarn to said spindle means, second motor means for driving said peripheral machinery means, second power source means for supplying electric power to said second motor means, second speed control means connected with said speed detecting means and with said second power source means for controlling a rotation speed of said second motor means, said second speed control means varying the frequency of said second power source means in response to said speed signal, and said second power source means supplying power therefrom with the varied frequency to said peripheral machinery means so as to effect rotation of said peripheral machinery means in accordance with the rotation speed of said spindle means, wherein said frequency of said second power source means is varied so as to drive said peripheral machinery means at a rotation speed with a constant ratio to that of said spindle means.

* * * * *